US005278739A

United States Patent [19]

Gammache

[11] Patent Number: 5,278,739

[45] **Date of Patent: * Jan. 11, 1994**

[54] SWIVEL HEAD FLASHLIGHT

[76] Inventor: Richard J. Gammache, 1564 Mission Rd., Lancaster, Pa. 17601

[ * ] Notice: The portion of the term of this patent subsequent to Mar. 17, 2009 has been disclaimed.

[21] Appl. No.: 850,939

[22] Filed: Mar. 13, 1992

Related U.S. Application Data

[63] Continuation-in-part of Ser. No. 742,872, Aug. 9, 1991, Pat. No. 5,097,399, which is a continuation-in-part of Ser. No. 565,854, Aug. 9, 1990, Pat. No. 5,043,854.

[51] Int. Cl.[5] ..... F21L 7/00

[52] U.S. Cl. ..... 362/197; 362/199; 362/205; 362/207

[58] Field of Search ..... 362/188, 197-205; 194; 196; 208; 207

[56] References Cited

U.S. PATENT DOCUMENTS

| | | | |
|---|---|---|---|
| 1,093,287 | 4/1914 | Neff | 362/206 |
| 1,173,984 | 2/1916 | Rosenfeld | 362/206 |
| 1,340,550 | 5/1920 | Madigan | 362/206 |
| 1,404,258 | 1/1922 | Alschuler | 362/206 |
| 1,832,563 | 12/1927 | Kuhn | 362/206 |
| 1,986,281 | 9/1931 | Nygard | 240/10.67 |
| 2,225,936 | 12/1940 | Williams | 240/10.68 |
| 2,256,641 | 9/1941 | Fullmer | 362/206 |
| 2,259,673 | 10/1941 | White | 240/10.67 |
| 2,312,670 | 3/1943 | Olds | 240/10.6 |
| 2,503,287 | 4/1950 | Moore | 362/206 |
| 3,835,272 | 9/1974 | Wisenbaker | 200/60 |
| 4,433,365 | 2/1984 | Rousseau | 632/189 |
| 4,737,892 | 4/1988 | Ohashi | 362/206 |
| 4,841,417 | 6/1989 | Maglica | 362/206 |
| 4,890,203 | 12/1989 | Watson | 362/102 |
| 4,907,135 | 3/1990 | Tarrson | 362/109 |
| 4,914,555 | 4/1990 | Gammache | 362/183 |
| 4,937,713 | 6/1990 | Holt | 362/186 |
| 4,956,755 | 9/1990 | Maglica | 362/206 |
| 5,097,399 | 3/1992 | Gammache | 362/199 |

*Primary Examiner*—James C. Yeung
*Attorney, Agent, or Firm*—Larry W. Miller

[57] ABSTRACT

A flashlight having a casing containing a pair batteries, a head assembly mounted on an upper end of the casing, and a tail assembly mounted on a lower end of the casing disclosed wherein the head assembly includes a swivel head carrying a bulb and a reflector and is rotatable about an inclined swivel axis aligned with a bulb extending through a side of a reflector. The flashlight includes a terminal mechanism for electrically connecting the bulb to the battery irrespective of the rotated position of the swivel head relative to the casing. A rotary switch mechanism is provided in the tail assembly to control the illumination of the bulb through a cam mechanism actuated by a rotation of the tail cap switch.

16 Claims, 5 Drawing Sheets

SWIVEL HEAD FLASHLIGHT

CROSS-REFERENCE TO RELATED APPLICATIONS

This application is a continuation-in-part of U.S. patent application Ser. No. 07/742,872, filed Aug. 9, 1991, and issued as U.S. Pat. No. 5,097,399, which is a continuation-in-part of U.S. patent application Ser. No. 07/565,854, filed Aug. 9, 1990, and issued as U.S. Pat. No. 5,043,854, both applications being incorporated herein by reference.

BACKGROUND OF THE INVENTION

This invention relates generally to flashlights and, particularly, to a flashlight having a swivel head rotatable in a plane oriented at an acute angle to the longitudinal axis of the casing, and also particularly to a rotary tail cap switch for flashlights.

Flashlights typically are constructed with an elongated casing to hold a supply of batteries electrically connected to a light bulb positioned to cast a beam of light along the general direction of the major axis of the casing. Specialty flashlights have been devised to provide a swivel head that rotates in a plane oriented at approximately 45 degrees to the major longitudinal axis of the casing. Such a swivel head structure would permit the beam of light cast by the illuminated light bulb to project along a path ranging from being parallel to the longitudinal axis of the casing to being perpendicular thereto.

The use of parabolic reflectors in flashlights has improved the quality of the beam of light projecting therefrom. Slight adjustable movements of the light bulb relative to the focal point of the parabolic reflector enables the beam of light to be focused for maximizing the quality of the projected light beam. Combining the use of a parabolic reflector with a swivel head flashlight structure has resulted in problems associated with the mounting of the light bulb and the electrical connection thereof to the batteries supplying a source of electrical current, which in turn provides opportunity for improvement to such flashlights.

SUMMARY OF THE INVENTION

The present invention provides a flashlight comprising a casing containing a battery, a head assembly mounted on the upper end of the casing and including a swivel head carrying a bulb, and a tail cap assembly mounted on a lower end of the casing and including a rotary switch mechanism for controlling the flow of electrical current to the light bulb for illuminating and extinguishing the bulb. The swivel head is rotatable about an axis of rotation which is inclined with respect to the longitudinal axis of the casing.

The head assembly also includes a socket member mounted in the swivel head for slidably receiving a bottom portion of the bulb. A lens cap is mounted on the swivel head, and resilient means in the lens cap urges an annular flange on the bulb into engagement with an annular flange on the socket member. The annular bulb flange forms a terminal which is electrically connected to a negative terminal of the battery by operating a rotary switch mechanism in the tail cap assembly. The light bulb has another terminal on the bottom portion thereof which is connected electrically to a positive terminal of the battery.

Another embodiment of the invention provides for the placement of the light bulb through the side of the parabolic reflector so that at least the filament of the bulb, which is positioned at the focal point of the reflector, if not the entire bulb, is aligned with the axis of rotation of the swivel head.

The tail cap assembly also includes a rotatable tail cap which forms a rotary switch for the actuation of the illumination of the light bulb. A spring electrically connects the conductive mechanism at the lower end of the flashlight casing with the negative terminal of the battery in order to complete the electrical circuit to illuminate the light bulb. The rotary switch mechanism includes a lifter movable in response to the rotation of the tail cap for lifting the spring out of contact with the conductive mechanism to break the electrical circuit between the conductive mechanism and the battery negative terminal in order to extinguish the bulb.

It is an object of this invention to overcome the aforementioned disadvantages of the prior art to provide a flashlight with a swivel head selectively operable to cast a beam of light in a selected path along a range of perpendicularly extending positions.

It is another object of this invention to provide a flashlight with a swivel head in which the filament of the bulb is oriented at the focal point of a parabolic reflector and along the axis of rotation of the swivel head.

It is a feature of this invention that the light bulb can be positioned within an opening located in the side of a parabolic reflector.

It is still another object of this invention to provide a terminal mechanism for a swivel head flashlight that will maintain electrical contact with the light bulb while the bulb is rotated with the swivel head from one rotated position to another.

It is another feature of this invention that the terminal mechanism associated with the light bulb includes an annular flange engageable with brushes that rotate with the swivel head to maintain electrical contact throughout the range of rotated positions of the swivel head.

It is an advantage of this invention that the swivel head rotates about an axis of rotation generally coinciding with the axial alignment of the light bulb.

It is another advantage of this invention that at least the filament of the light bulb is aligned on the axis of rotation of the swivel head.

It is still another advantage of this invention that the flashlight is provided with a quarter-turn rotary tail cap switch that controls the illumination of the light bulb.

It is yet another object of this invention to provide a swivel head flashlight that is durable in construction, inexpensive of manufacture, carefree of maintenance, facile in assemblage, and simple and effective in use.

These and other objects, features and advantages are accomplished according to the instant invention by providing a swivel head flashlight in which the light bulb extends into the parabolic reflector through an opening in the side of the reflector. The swivel head of the flashlight is rotatable about an axis of rotation passing through the filament of the bulb and, preferably, coinciding with the axis of the bulb. A terminal mechanism associated with the light bulb permits continuous electrical contact during rotation of the swivel head by utilizing brushes rotating around an annular flange. The tail cap assembly incorporates a quarter-turn rotary switch for controlling the illumination of the light bulb. The tail cap switch incorporates a lifter operable to move a spring out of contact with the tail cap conductive mechanism to break the electrical circuit and extinguish the light bulb.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
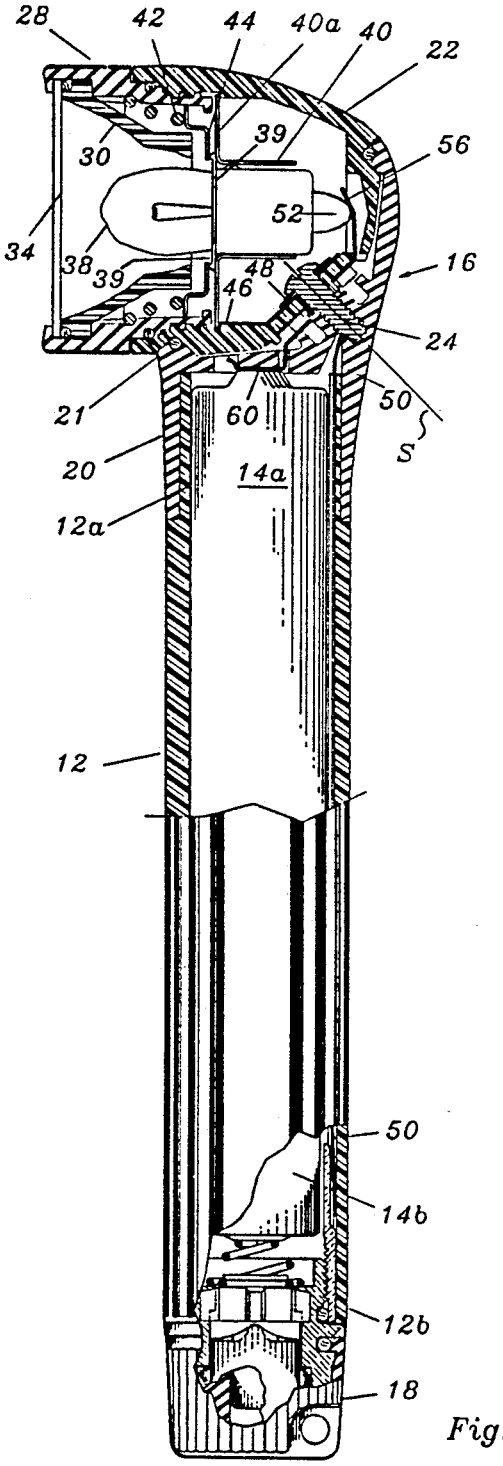
FIG. 1 is a side elevational view of the swivel head flashlight incorporating the principles of the instant invention, portions of the flashlight casing being broken away for purposes of clarity, the swivel head is positioned to cast a beam of light perpendicularly to the longitudinal axis of the casing.
Figure 2:
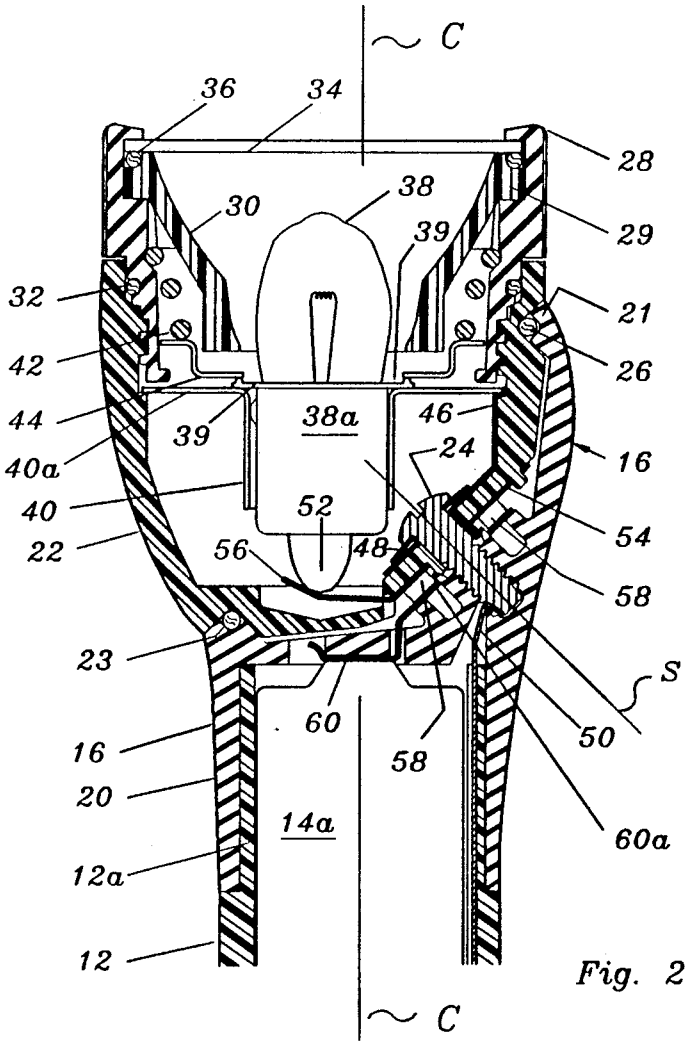
FIG. 2 is an enlarged cross-sectional view of the head assembly located on the upper end of the flashlight casing, the swivel head being rotated to direct a beam of light generally parallel to the longitudinal axis of the casing.
Figure 3:
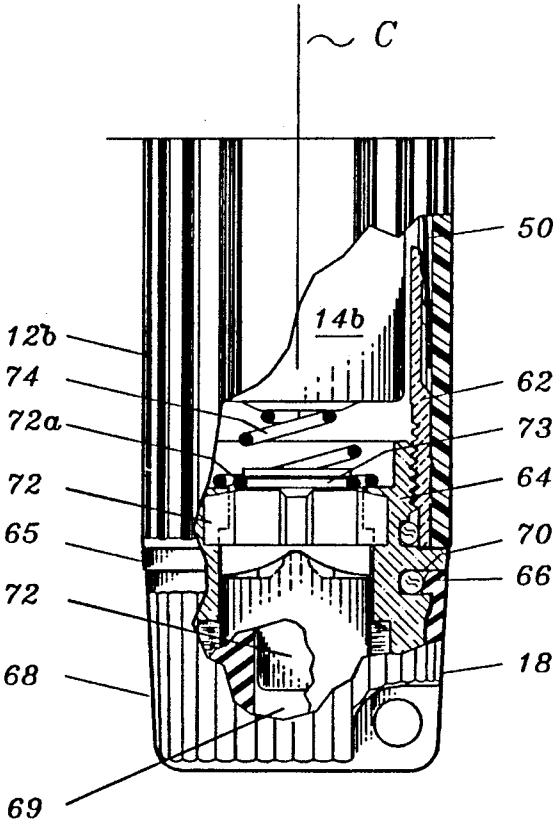
FIG. 3 is an enlarged cross-sectional view of the tail cap assembly with the casing being broken away, located at the lower end of the flashlight casing to show the rotary tail cap switch.

Referring now to FIGS. 1-3, a flashlight 10 includes a cylindrical casing 12 containing a pair of batteries 14*a*, 14*b*. A head assembly 16 is mounted on an upper end 12*a* of the casing 12, while a tail assembly 18 is mounted on a lower end 12*b* of the casing 12. The head assembly 16 includes a base 20 secured to the casing upper end 12*a* and a swivel head 22 rotatably fastened to the base 20 by a bolt 24. The base 20 and the swivel head 22 are preferably formed of nonconductive material such as nylon. An annular groove 23 in the swivel head 22 is engaged with an annular flange 21 on the base 20. An O-ring 26 is disposed in the groove 23. The swivel head 22 is arranged for rotational movement about a swivel axis of rotation S which is disposed at an acute angle of approximately 45 degrees with respect to the longitudinal axis C of the casing 12. Since the swivel axis S coincides with the longitudinal centerline of the bolt 24, the swivel head 22 is rotatable about the bolt 24.

Figure 5:
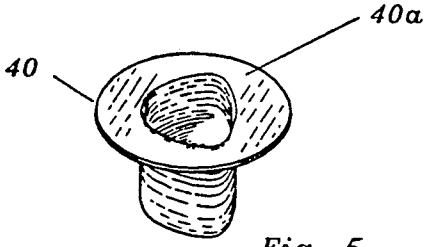
FIG. 5 is a perspective view of the bulb socket member forming part of the swivel head assembly.

A lens cap 28 is threaded into the swivel head 22, and a reflector 30 is mounted in the lens cap 28. The lens cap 28 and the reflector 30 are made of conductive or nonconductive material. An O-ring 32 is disposed between the lens cap 28 and the swivel head 22. A lens 34 and an O-ring 36 are mounted in a groove 29 in the lens cap 28. The swivel head 22 carries a bulb 38 and a socket member 40 slidably receiving a bottom portion 38*a* of the bulb 38. When the lens cap 28 is installed on the swivel head 22, resilient means such as a spring 42 retained in the lens cap 28 urges a ring 44 into engagement with an annular flange 39 on the bulb 38, thereby urging this flange 39 into contact with an annular surface 40*a* of the socket member 40, and clamping the bulb 38 between the ring 44 and the socket member 40 to restrict the bulb 38 from further movement. The bulb 38 may be removed from the flashlight 10 when the lens cap 28 is unthreaded from the swivel head 22 The socket member 40 (also shown in FIG. 5) and ring 44 are formed of conductive material such as aluminum or steel.

When the bulb 38 is illuminated, rotational movement of the lens cap 28 relative to the swivel head 22 causes the reflector 30 to focus the beam of light emitted by the bulb 38 from a wide angle beam to a narrow beam. This rotational movement of the lens cap 28 also increases and decreases the compression in the spring 42, but the bulb flange 39 is retained in contact with the annular surface 40*a* of the socket member 40.

The bulb flange 39 forms an electrical terminal which is connected to a negative terminal of the battery 14*b* via the socket member 40, a socket contact 46, a spring washer 48, bolt 24, a terminal contact 50 and a tail assembly 18. Terminal contact 50 extends lengthwise of the casing 12 from its upper end 12*a* to its lower end 12*b*. Socket contact 46, spring washer 48 and terminal contact 50 are made of conductive material such as brass. Bulb 38 has another electrical terminal 52 which contacts tabs 56 on a rotor contact 54, preferably formed of beryllium copper. The tabs 56 may be deflected to accommodate bulbs of varying lengths.

Figure 4A:
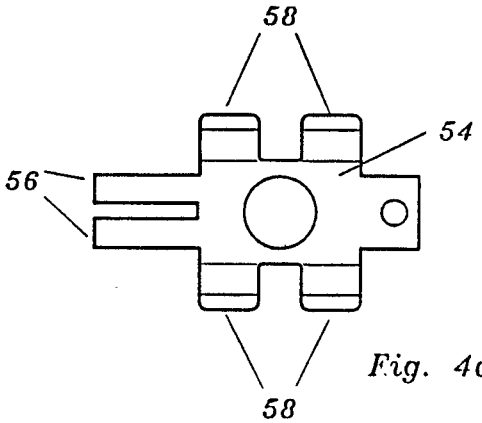
FIG. 4*a* is a flat pattern of the rotor contact forming a portion of the terminal mechanism associated with maintaining electrical contact between the batteries and the light bulb during rotation of the swivel head carrying the light bulb relative to the flashlight casing housing the batteries.
Figure 4B:
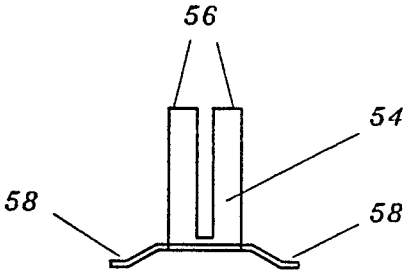
FIG. 4*b* is an end view of the rotor contact shown in FIG. 4*a* with the portions thereof bent along the lines indicated in the flat pattern of FIG. 4*a*.

This rotor contact 54 (also shown in FIGS. 4*a* and 4*b*) is attached to the swivel head 22 to be rotatable therewith in fixed relation to said bulb 38 in contact with said tabs 56. The rotor contact 54 has a plurality of leaf spring-like projections 58 concentrically positioned around the swivel axis S to sweepingly engage, as the rotor contact 54 is rotated with said swivel head 22, an annular portion 60*a*, concentrically positioned around the swivel axis S, of a fixed battery contact 60 constructed of brass that is connected to a positive terminal of the battery 14*a*. Swivel head 22 is fastened to the base 20 by the bolt 24 which extends through holes in the rotor contact 54 and the annular portion 60*a* of the battery contact 60 without contacting either the rotor contact 54 or the battery contact 60. The bolt 24 is preferably made of steel and is engaged with an upper end of the terminal contact 50.

When the swivel head 22 is rotated relative to the base 20 about the swivel axis S, the reflector 30 and the bulb 38 are moved to different positions with respect to the casing 12 in order to direct the beam of light from the bulb 38 in different directions. For example, in FIG. 1, the swivel head 22 is rotated so that the reflector 30 and the bulb 38 are in a generally horizontal position to cast a beam of light generally perpendicularly to the longitudinal axis of the casing 12. When the swivel head 22 is rotated 180 degrees about the swivel axis S, as depicted in FIG. 2, the reflector 30 and the bulb 38 will be moved through an arc of 180 degrees to a generally vertical position to cast a beam of light generally parallel to the longitudinal axis of the casing 12, and generally perpendicular to the beam of light cast in the orientation depicted in FIG. 1. This movement of the reflector 30 and the bulb 38 can be accomplished due to the unique shape of the swivel head 22 which is asymmetrical with respect to a horizontal transverse plane extending through the swivel head 22 in FIG. 1.

Figure 6:
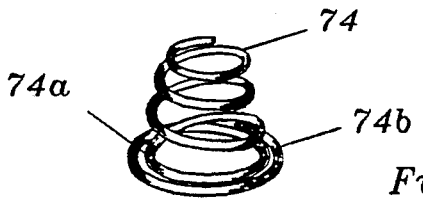
FIG. 6 is a perspective view of the spring used in the tail cap assembly.
Figure 7:
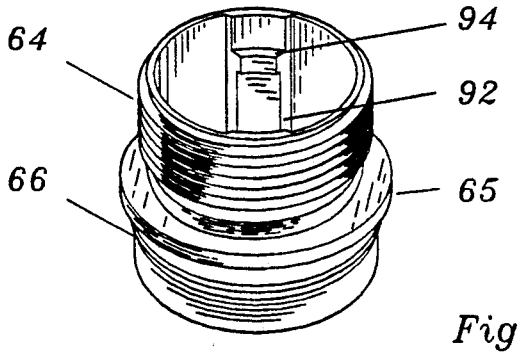
FIG. 7 is a perspective view of the switch retainer forming part of the tail cap assembly.
Figure 8:
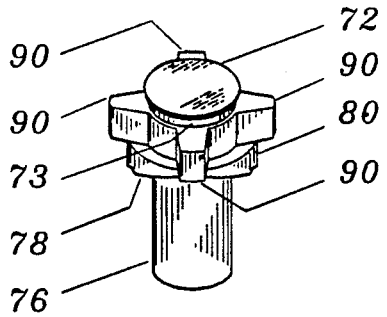
FIG. 8 is a perspective view of the lifter forming part of the rotary switch mechanism located in the tail cap assembly.
Figure 9:
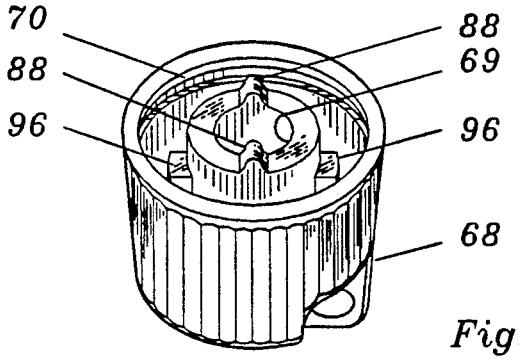
FIG. 9 is a perspective view of the tail cap forming part of the tail cap assembly.
Figure 10:
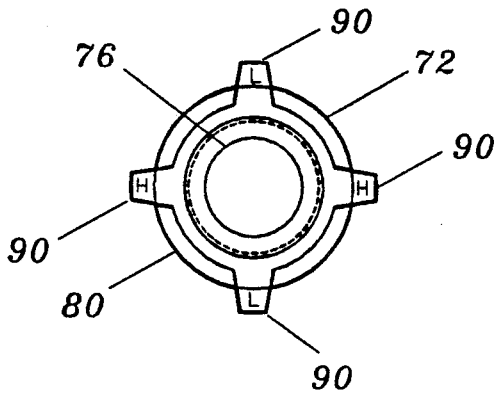
FIG. 10 is an enlarged top plan view of the lifter shown in FIG. 8.
Figure 11:
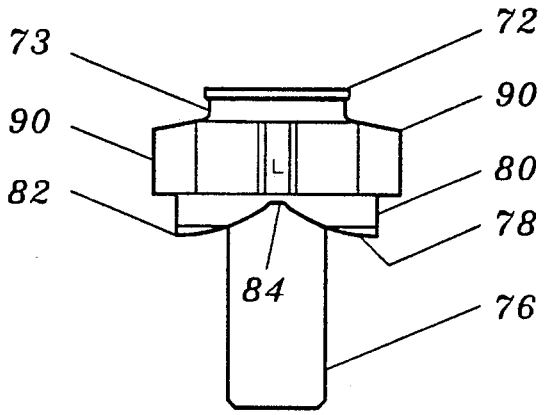
FIG. 11 is an elevational view of the lifter shown in FIGS. 8 and 10.
Figure 12:
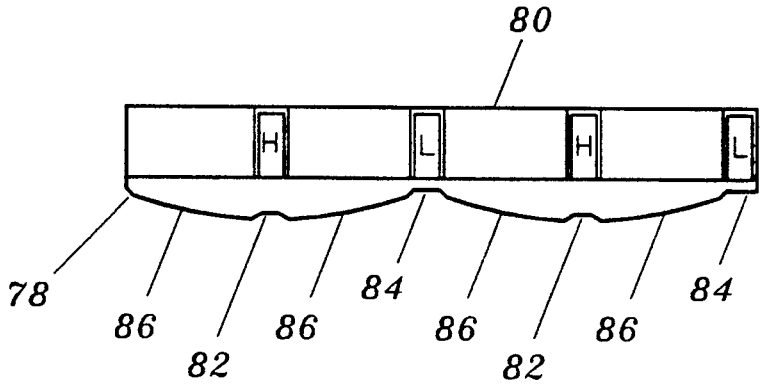
FIG. 12 is a schematic representation of the lifter shown in FIG. 11.

Referring to FIGS. 3 and 6–12, the tail assembly 18 includes a conductive insert 62 mounted in the lower end **12*b* of the casing 12. The insert 62 is conductively engaged with a lower end of the terminal contact 50. A retainer 64 (also shown in FIG. 7) threaded into the insert 62 has a flange 65 engaged between the lower end 12*b* of the casing 12 and a tail cap 68 (also shown in FIG. 9) which is rotatably mounted on the switch retainer 64. An annular barb 66 on the retainer 64 is engaged in a annular groove 70 in the tail cap 68. The insert 62 and the retainer 64 are formed of metallic material such as aluminum, whereas the tail cap 68 is made of a plastic material, such as nylon. Mounted in the tail cap 68 is a lifter 72 formed of plastic material. A spring 74, made of steel and shown in FIG. 6, is compressed between the lifter 72 and the negative terminal of the battery 14*b*. The spring 74 has an inner bottom coil 74*a* which is snapped into a groove 73 on the lifter 72**.

The lifter 72 (also shown in FIGS. 8, 10 and 11) has a center post 76 slidably disposed in a hole 69 in the tail cap 68. The lifter 72 has a cam surface 78 on the underside of a flange 80. As best seen in the schematic representation of FIG. 12, the cam surface 78 includes a pair of high detents 82 and a pair of low detents 84 with inclined ramps 86 extending between the detents 82, 84. The tail cap 68 has a pair of cam lobes 88 arranged for engagement with the cam surface 78 on opposing sides of the lifter 72. Four fins 90 extend outwardly on the lifter 72 to support an outer bottom coil **74*b* of the spring 74. The fins 90 engage two inwardly directed projections 92 formed on an inside cylindrical wall of the retainer 64 to prevent rotational movement of the lifter 72 relative to the retainer 64**.

When the tail cap 68 is rotated with respect to the casing 12, the cam lobes 88 ride along the inclined ramps 86 until they become engaged in either the high detents 82 or the low detents 84. If the tail cap 68 is rotated to an "off" position where the cam lobes 88 are engaged with the high detents 82, the lifter 72 is pushed upwardly from the "on" position as viewed in FIG. 3 and the outer bottom coil **74*a* of the spring 74 is lifted out of contact with a pair of ledges 94 on the retainer 64, thereby electrically disconnecting the retainer 64 and the negative terminal of the battery 14*b*. This extinguishes the bulb 38**.

If the tail cap 68 is rotated to an "on" position where the cam lobes 88 are engaged in the low detents 84, the lifter 72 moves downwardly as viewed in FIG. 3 and the outer bottom coil **74*b* of the spring 74 contacts the ledges 94 on the retainer 64, thereby electrically connecting the retainer 64 and the negative terminal of the battery 14*b*. This illuminates the bulb 38. The tail cap 68 is rotated 90 degrees with respect to the casing 12 between the "on" and "off" positions. Projections 96 formed inside the tail cap 68 are engageable with the inwardly directed projections 92 in the retainer 64 to limit the rotational movement of the tail cap 68** to a total angular deflection of 90 degrees between the "on" and "off" positions.

Figure 14:
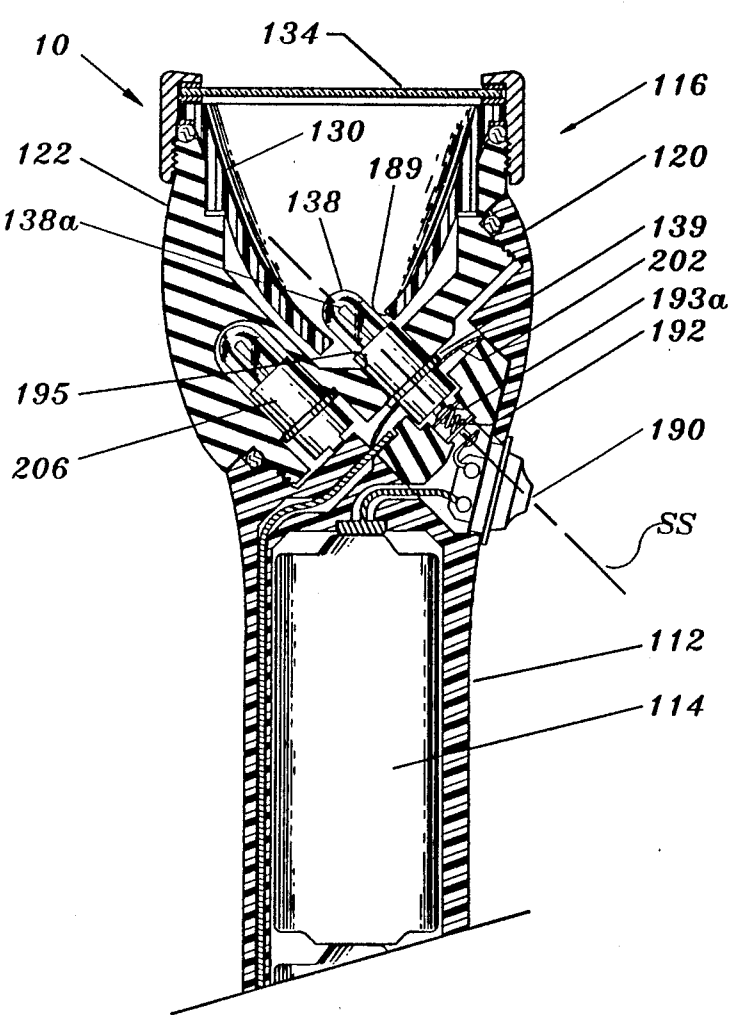
FIG. 14 is a cross-sectional view of the swivel head assembly shown in FIG. 13, but with the swivel head rotated to cast a beam of light parallel to the longitudinal axis of the casing.
Figure 13:
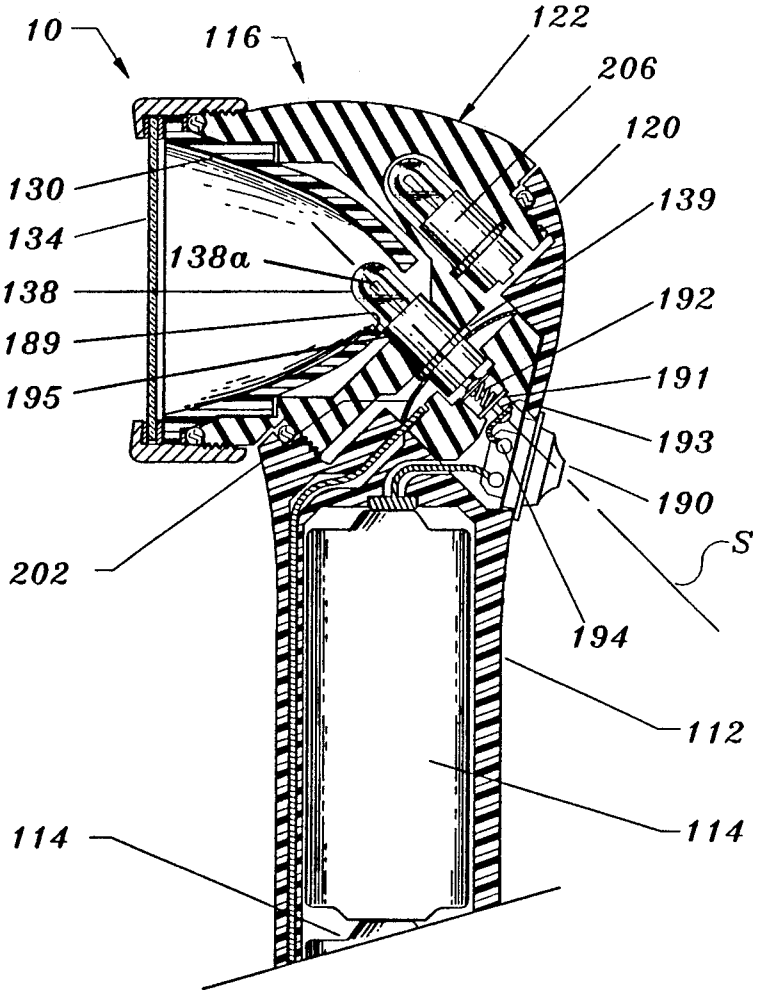
FIG. 13 is a cross-sectional view of an alternative embodiment of the swivel head assembly mounted on a flashlight casing with the swivel head oriented to cast a beam of light perpendicular to the longitudinal axis of the casing.

Referring now to FIGS. 13 and 14, an alternative embodiment of the flashlight 10 can best be seen. The flashlight 10 includes a casing 112 containing batteries 114, and a head assembly 116 which includes a swivel head 122 threaded into a base 120 for rotational movement about a swivel axis S. The swivel head 122 has a reflector 130 and a lens 134. A switching mechanism, generally depicted by reference numeral 190, electrically connects the batteries 114 to one terminal of the bulb 138 that is carried in a bore 195 in the swivel head 122. One skilled in the art will readily realize that the tail cap switching mechanism described above relative to FIGS. 3 and 6–12 would equally be usable in this alternative embodiment of the flashlight 10.

The bulb 138 extends through an angled hole 189 in the side of the reflector 130. A spring washer 202 is compressed between the base 120 and a flange 139 on bulb 138, thereby urging the bulb flange 139 against the swivel head 122. The flange 139 forms another terminal for the bulb 138 which can be electrically connected via the spring washer 202, the base 120 and the casing 112 in a conventional manner. The bulb 138 can be removed from the flashlight 10 by unthreading the swivel head 122 from the base 120. A spare bulb 206 is carried in a pocket 208 formed in the swivel head 122.

By positioning the bulb 138 through the hole 189 extending through the side of the reflector 130, the bulb 138 is oriented so as to be aligned with the swivel axis S. One skilled in the art will readily realize that the proper use of a parabolic reflector 130 requires the positioning of the filament **138*a* of the bulb 138 at the focal point of the parabolic reflector 130. The rotational movement of the swivel head 122 relative to the base 120, as shown in a comparison between FIGS. 13 and 14, to direct the beam of light emanating from the swivel head 122 in the desired direction between being generally parallel to the longitudinal axis of the casing to being generally perpendicular to the longitudinal axis of the casing, effects a slight translational movement of the swivel head 122 relative to the base 120. The filament 138*a* is maintained at the focal point of the parabolic reflector by the force of the spring washer 202 urging the bulb 138 against the swivel head 122**.

The alignment of the bulb 138 with the swivel axis S allows the swivel head 122 to rotate about the longitudinal axis of the bulb 138, which generally coincides with the swivel axis S. Since the bulb 138 is not attached to the swivel head 122, except through the frictional forces created by the biasing of the spring washer 202, the swivel head 122 can rotate about the bulb 138. With the filament **138*a* of the bulb 138 being aligned with the swivel axis S, which is also passing through the focal point of the reflector 130, the rotation of the swivel head 122 through an arc of 180 degrees relative to the base and about the bulb 138 does not disturb the quality of the beam emanating from the reflector 130**.

Since the bulb 138 maintains a generally fixed angular relationship relative to the casing 112, irrespective of the rotated position of the swivel head 122 relative to the base 120, while the reflector 130 is moved to different positions relative to the bulb 138 while being rotated with the reflector 130, the electrical connection of the bulb 138 to the batteries 114 can be more simply accomplished. The utilization of a small conductive spring 192, compressed between a bushing 191 retained in the base 120 and a shoulder 193*a* of a slidable contact 193 electrically connected to the switch terminal 194, urges the shoulder 193*a* against the one terminal of the bulb 138 to accommodate any translational movement of the bulb 138 to follow the swivel head 122 when rotated relative to the base 120, as urged by the spring washer 202, and maintain electrical connection between the bulb 138 and the switching mechanism 190.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. Accordingly, the following claims are intended to protect the invention broadly as well as in the specific form shown.

Having thus described the invention, what is claimed is:

1. A flashlight comprising:

a casing containing at least one battery, said casing having a longitudinal axis; and a head assembly mounted on said casing and including a swivel head carrying a bulb having a filament for emitting a beam of light, said swivel head being arranged for rotational movement about a swivel axis which is disposed at an acute angle with respect to said longitudinal axis of said casing to permit the beam of light emitted from said bulb to be directed in different directions, said bulb being mounted such that said swivel axis passes through said filament, such that said filament remains fixed on said swivel axis irrespective of the rotated position of said swivel head.

2. The flashlight of claim 1 further comprising:

a reflector carried by said swivel head operable to direct said beam of light through a lens assembly carried by said swivel head, said reflector having a hole in the side thereof to receive said bulb, said swivel axis passing through said hole.

3. The flashlight of claim 2 wherein said reflector is a parabolic reflector having a focal point generally coinciding with said filament.

4. The flashlight of claim 2 wherein said swivel axis passes through the center of said hole in the side of said reflector, said bulb having a longitudinal axis substantially aligned with said swivel axis

5. The flashlight of claim 4 wherein said swivel head rotates about said bulb.

6. The flashlight of claim 5 wherein said bulb is slidably received through said hole in the side of said reflector, said bulb being maintained in contact with said swivel head by a spring washer compressed between said bulb and said casing.

7. A flashlight comprising:

a casing containing at least one battery, said casing having a longitudinal axis;

a head assembly mounted on said casing and including a base member fixed to said casing; and a swivel head arranged for rotational movement relative to said base about a swivel axis which is disposed at an acute angle with respect to said longitudinal axis of said casing;

a reflector mounted in said swivel head for rotational movement therewith, said reflector having a hole passing through a side thereof such that said reflector is asymmetrical; and a bulb disposed within said hole in the side of said reflector, said bulb having a filament for emitting a beam of light which is directable in different directions corresponding to the rotated position of said swivel head relative to said base, said bulb being mounted such that said swivel axis passes through said filament, such that said filament remains fixed on said swivel axis irrespective of the rotated position of said swivel head.

8. The flashlight of claim 7 wherein said swivel axis passes through the center of said hole in the side of said reflector, said bulb having a longitudinal axis substantially aligned with said swivel axis, such that said swivel head rotates about said bulb.

9. The flashlight of claim 8 wherein said bulb is slidably received through said hole in the side of said reflector, said bulb being maintained in contact with said swivel head by a spring washer compressed between said bulb and said casing.

10. In a flashlight having a casing containing at least one battery, said casing having a longitudinal axis; a head assembly mounted on said casing and including a swivel head carrying a bulb having a positive terminal, a negative terminal, and a filament for emitting a beam of light, said swivel head being arranged for rotational movement about a connector defining a swivel axis which is disposed at an acute angle with respect to said longitudinal axis of said casing to permit the beam of light emitted from said bulb to be directed in different directions; and a terminal mechanism electrically interconnecting said positive and negative terminals of said bulb and said at least one battery, an improved terminal mechanism comprising:

a battery contact electrically connected to a positive battery terminal, said battery contact being fixed to said casing and including an annular portion being concentric with said swivel axis;

a rotor contact mounted in said swivel head to be rotatable therewith in fixed relation to said bulb, said rotor contact having a tab electrically connected to said positive terminal of said bulb and at least one projection engageable with the annular portion of said battery contact irrespective of the rotated position of said rotor contact relative to said battery contact, said at least one projection brushing against the annular portion of said battery contact as said swivel head is rotated relative to the casing to provide a current path between said positive battery terminal and said bulb without passing through said connector; and a socket contact assembly electrically interconnecting said negative terminal of said bulb and a negative terminal of said battery through siad connector, which is electrically insulated from both said battery contact and said rotor contact.

11. The flashlight of claim 10 wherein said connector passes through openings in said rotor contact and in the annular portion of said battery contact without contacting either said rotor contact or said battery contact.

12. The flashlight of claim 11 wherein said rotor contact includes a plurality of projections concentrically spaced around said connector to sweepingly engage the annular portion of said battery contact as said swivel head is rotated about said connector.

13. In a flashlight having a casing containing a battery, a head assembly mounted on a upper end of said casing and carrying a bulb operable when electrically connected to said battery to cast a beam of light from said head assembly, and a tail assembly mounted on a remote lower end of said casing, said tail assembly including a rotary switching mechanism selectively operable to control the electrical connection of an electrical circuit between said battery and said bulb for illumination of said bulb, a improved rotary switch comprising:

an external rotary switch forming part of said tail assembly, said rotary witch being moveable between first and second positions;

a cam mechanism operatively connected to said rotary switch such that upon movement of said rotary switch form said first position to said second position, said cam mechanism breaks said electrical circuit to extinguish said bulb; and said electrical circuit including a conductive member in the form of a spring electrically engaged with said battery, said cam mechanism including a lifter engageable with said spring, said lifter moving said spring to break said electrical circuit upon rotation of said rotary switch from said first position to said second position.

14. The flashlight of claim 13 wherein said lifter is provided with high and low detents, corresponding with said first and second positions of said rotary switch, with inclined ramps extending therebetween, said rotary switch having cam lobes engageable with said lifter between said high and low detents, said spring retaining said lifter against said cam lobes when engaged with said detents to retain said rotary switch in the selected one of said first and second positions.

15. The flashlight of claim 14 wherein said tail assembly includes limit means engageable with said rotary switch to limit rotation thereof to said first and second positions.

16. The flashlight of claim 15 wherein said tail assembly is threaded onto said casing and is rotatably translatable along said casing by the engagement of said limit means between said rotary switch and said tail assembly so that continued rotation of said rotary switch effects a rotation of said tail assembly.

* * * * *